US009848721B2

(12) United States Patent
Turner et al.

(10) Patent No.: US 9,848,721 B2
(45) Date of Patent: Dec. 26, 2017

(54) UNIVERSAL LID FOR FOOD AND DRINK CONTAINERS

(71) Applicant: Double Double Inc., San Francisco, CA (US)

(72) Inventors: Sativa Turner, San Francisco, CA (US); Michelle Ivankovic, Amsterdam (NL)

(73) Assignee: Double Double Inc., San Francisco, CA (US)

( * ) Notice: Subject to any disclaimer, the term of this patent is extended or adjusted under 35 U.S.C. 154(b) by 0 days.

(21) Appl. No.: 14/779,396

(22) PCT Filed: Mar. 24, 2014

(86) PCT No.: PCT/US2014/031582
§ 371 (c)(1),
(2) Date: Sep. 23, 2015

(87) PCT Pub. No.: WO2014/160642
PCT Pub. Date: Oct. 2, 2014

(65) Prior Publication Data

US 2016/0051069 A1 Feb. 25, 2016

Related U.S. Application Data

(60) Provisional application No. 61/804,714, filed on Mar. 24, 2013.

(51) Int. Cl.
*B65D 47/04* (2006.01)
*A47G 19/22* (2006.01)
(Continued)

(52) U.S. Cl.
CPC ..... *A47G 19/2272* (2013.01); *A61J 11/0065* (2013.01); *A61J 11/02* (2013.01);
(Continued)

(58) Field of Classification Search
CPC ..... A61J 11/0065; A61J 11/02; A61J 11/045; A61J 11/04; A61J 11/006; A61J 11/06;
(Continued)

(56) References Cited

U.S. PATENT DOCUMENTS 1,243,033 A 10/1917 Beatty
1,439,170 A 12/1922 Kawasaki
(Continued)

FOREIGN PATENT DOCUMENTS

GB 370027 3/1932
GB 2417952 B 4/2009
WO 2014040039 A1 3/2014

OTHER PUBLICATIONS

International Search Report for PCT/US2014/031582 dated Aug. 21, 2014.

(Continued)

*Primary Examiner* — Charles P Cheyney
(74) *Attorney, Agent, or Firm* — PK Patent Law

(57) ABSTRACT

The present disclosure is directed to a universal food and drink lid. The lid is formed of a stretchy material so that it can fit on a plurality of containers of different sizes. The lid is also formed of a material with sufficient elasticity so that once it is fit onto a container, such as a cup or a bowl, the lid forms a seal therewith that allows for a spill-proof connection between the container and the lid. The lid may further include an outlet for removing the contents of the container without removing the lid. The lid may further include an outlet that is a spout, an opening with a movable stopper, a straw opening or an opening sized to fit the hand of a user.

20 Claims, 14 Drawing Sheets

(51) Int. Cl.

| | |
|---|---|
| ***A61J 11/00*** | (2006.01) |
| ***A61J 11/02*** | (2006.01) |
| ***A61J 11/04*** | (2006.01) |
| ***B65D 47/06*** | (2006.01) |
| ***B65D 47/32*** | (2006.01) |

(52) U.S. Cl.
CPC ..... *A61J 11/045* (2013.01); *B65D 47/06* (2013.01); *B65D 47/32* (2013.01)

(58) Field of Classification Search
CPC ..... A61J 11/008; A61J 11/0085; B65D 47/06; B65D 47/32; B65D 2543/00046; B65D 41/14; B65D 41/22; A47G 19/2272
USPC ..... 222/567, 570; 220/709, 287, 380, 703, 220/711–718; 215/319, 11.1, 11.5, 387
See application file for complete search history.

(56) References Cited

U.S. PATENT DOCUMENTS 1,983,139 A 12/1934 Lovell
2,003,657 A 6/1935 Stubblefield
2,064,411 A 12/1936 Brandstein
2,080,108 A 5/1937 Brandstein
2,199,787 A 5/1940 Dillard
2,266,270 A * 12/1941 Roth ..... B65D 41/02 215/317
2,443,560 A * 6/1948 Goodson ..... A61J 11/02 215/11.5
2,530,999 A 11/1950 Schuler
2,550,568 A 4/1951 Kersh
2,569,139 A * 9/1951 Abelson ..... A47G 19/2272 215/11.1
D165,778 S 1/1952 Olsen
2,608,841 A 9/1952 Rice
2,689,664 A 9/1954 Vingron
2,693,187 A * 11/1954 Perreault ..... A61J 11/02 215/11.1
2,804,242 A 8/1957 Borah
2,839,229 A * 6/1958 Scheswohl ..... B65D 47/122 215/307
2,905,350 A 9/1959 Edwards
3,093,273 A 6/1963 Borah
3,207,377 A 9/1965 Lemelson
3,434,589 A 3/1969 Valtri
3,765,048 A 10/1973 Zakhi
4,246,945 A 1/1981 Sterling
4,328,904 A 5/1982 Iverson
4,403,709 A 9/1983 Meins et al.
4,542,833 A 9/1985 Devaughn
4,609,113 A 9/1986 Seki
4,640,855 A 2/1987 St. Clair
4,815,628 A 3/1989 Wehnert, III
4,901,881 A * 2/1990 McElroy ..... B65D 41/22 215/229
5,036,994 A * 8/1991 McElroy ..... A47G 19/2211 215/228
5,186,347 A 2/1993 Freeman et al.
5,370,253 A 12/1994 Kite
D364,314 S 11/1995 Humphrey et al.
5,474,028 A * 12/1995 Larson ..... A01K 9/005 119/71
5,586,681 A 12/1996 Policappelli
5,762,230 A 6/1998 Policappelli
5,769,285 A * 6/1998 Upham ..... A01K 9/005 215/11.1
5,797,505 A * 8/1998 Kaura ..... A61J 11/0015 215/11.1
D398,813 S 9/1998 Franzese
5,816,428 A 10/1998 Plester et al.
5,988,425 A 11/1999 Yehl et al.
D430,455 S 9/2000 Pickens
6,112,926 A 9/2000 Fishman
D436,539 S 1/2001 Spreitzer et al.
6,176,384 B1 1/2001 Voloshin
6,260,731 B1 7/2001 Cummings
6,305,584 B1 10/2001 Dobobrov et al.
6,311,861 B1 11/2001 Policappelli
6,354,458 B1 3/2002 Policappelli
6,609,630 B1 8/2003 Freeman et al.
D479,946 S 9/2003 Jalet et al.
6,877,626 B2 4/2005 Sherrod
6,883,677 B2 4/2005 Goeking et al.
7,134,564 B2 * 11/2006 Verbovszky ..... A61J 11/0015 215/11.1
7,185,784 B2 3/2007 Connors, Jr. et al.
D545,137 S 6/2007 Furlong et al.
7,318,534 B2 1/2008 Turvey et al.
7,654,402 B2 2/2010 Kusuma et al.
7,678,271 B2 * 3/2010 Curtin ..... A47J 43/24 141/337
D616,249 S 5/2010 Galinski
7,854,336 B2 12/2010 Kerner et al.
7,908,823 B2 3/2011 Edmunds
8,123,885 B2 2/2012 Sadlier
8,302,798 B2 11/2012 Moss
8,317,046 B2 11/2012 Vanderberg et al.
8,317,047 B2 11/2012 Vanderberg et al.
8,365,944 B2 2/2013 Vanderberg et al.
8,424,708 B2 4/2013 Vanderberg et al.
8,448,813 B2 5/2013 Vanderberg et al.
8,534,486 B2 9/2013 Edmunds
8,844,764 B2 9/2014 Curtin et al.
2002/0158075 A1 10/2002 Caldicott et al.
2004/0000551 A1 1/2004 Flink et al.
2005/0127074 A1 6/2005 Kusuma et al.
2006/0131308 A1 6/2006 Drake
2007/0090081 A1 4/2007 Briscoe
2008/0035665 A1 * 2/2008 Edmunds ..... B65D 41/22 221/208
2010/0012670 A1 1/2010 Massey
2010/0200530 A1 * 8/2010 Terwilleger ..... A01K 9/005 215/11.1
2011/0056968 A1 3/2011 McNamara et al.
2011/0240589 A1 * 10/2011 Averill ..... B65D 41/18 215/321
2012/0067910 A1 3/2012 Chun
2012/0145727 A1 6/2012 Gammage
2012/0318697 A1 12/2012 Stern
2012/0325833 A1 12/2012 Connors, Jr. et al.
2014/0061193 A1 * 3/2014 Sudakoff ..... B65D 21/086 220/200
2014/0069947 A1 3/2014 Smith et al.
2014/0360909 A1 12/2014 Curtin et al.
2015/0083736 A1 3/2015 Wheeler et al.
2015/0359365 A1 * 12/2015 Feeley ..... A47G 19/2272 220/713

OTHER PUBLICATIONS

YouTube Video showing SipSnap, "https://www.youtube.com/watch?v=_2OI-xN_V3U", Mar. 17, 2014.
YouTube Video showing SipSnap by Double Double, "https://www.youtube.com/watch?v=SIrH6Qd4AuQ", Feb. 25, 2014.
Kickstarter website, "https://www.kickstarter.com/projects/sipsnap/sipsnap/description", Mar. 5, 2014.

* cited by examiner

UNIVERSAL LID FOR FOOD AND DRINK CONTAINERS

CROSS-REFERENCE TO RELATED APPLICATIONS

This application is a national stage 35 U.S.C. 371 filing of International Application No. PCT/US2014/031582, filed on Mar. 24, 2014.

This application claims priority to U.S. Provisional Application No. 61/804,714, filed Mar. 24, 2013, which is expressly incorporated herein by reference.

FIELD OF THE DISCLOSURE

The present disclosure is directed to a universal lid for food and drink containers. More particularly, the present disclosure is directed to a universal lid that can be applied to containers of various sizes and includes an opening for accessing the contents without removing the lid.

BACKGROUND OF THE DISCLOSURE

Various groups of people need containers with spill-proof lids. Consider in particular the needs of a parent and child. Children often knock their drinks over and, as a result, usually drink from sippy cups. Parents purchase numerous sippy cups, so that there is an ample supply of these cups for use. Consider also, an adult drinking coffee in the morning and needing to leave for work or to walk the dog. A special travel mug must be used to prevent the coffee from spilling during their commute to work or outing. In addition, it is helpful to have spill-proof food containers from which children can snack. Again, parents must purchase numerous snack traps, so that there is an ample supply of these containers for use. In all three of these examples, there is a predetermined lid for each container so that in order to use the cup or snack trap, the lid and container must match. As a result, people can spend time searching for the matching lid and containers, which can be frustrating. In addition, storage of the lids and containers can use up limited storage space in the kitchen. Furthermore, when on the go, carrying conventional sippy cups, snack traps and/or travel mugs can increase the need for a large bag and toting around multiple devices.

While many spill-proof lids have been created which allow food and drink access by mouth or hand, they are not versatile and can only fit one particularly sized vessel. Without the required sized vessel, the lid becomes useless. Some lids have been created to fit a selective number of different sized containers. However, these lids are also useless with out the matching containers. Furthermore, these lids may not include an area which allows you to drink the liquid or reach in to pull food out. As a result, you must remove the lid to drink or eat, which could be messy.

Thus, a need exists for a lid that can fit various sized containers and allow a user to access food or drink therein without removing the lid. Furthermore, a need exists for these containers to be usable by children and/or adults.

BRIEF SUMMARY OF THE DISCLOSURE

The present disclosure relates to a stretchy, flexible lid, which can be pulled over a container or vessel used to hold liquid or food. This flexible lid may contain a spill-proof access point by which liquid can be drunk from the mouth and/or food can be reached with fingers or otherwise retrieved. The flexibility of the lid material allows it to be stretched to fit over a variety of vessels of different shapes and sizes. This universality or ability of the lid to change sizes makes the lid practical for use anywhere that food and drink are consumed including, but not limited to, in the house, in the car, at restaurants, outdoors, while traveling or on-the-go. In addition, the lid of the present disclosure provides an easy to use, inexpensive to manufacture lid for various uses. The lid also allows a caregiver to select the container material for their child.

The present invention uniquely allows a user to add a spill-proof lid to any drinking cup in one's possession such as in a kitchen cupboard, at a restaurant or anywhere.

The present lid includes a flexible top wall with an outlet and a flexible sidewall integrally formed therewith. The top wall and sidewall can be stretched to fit a plurality of different sized containers and allow access to food or liquid therein without removing the lid. Upon applying the lid on the container, the flexible sidewall stretches from an initial state to a second state where the top wall and said sidewall are taut and the flexible sidewall closes the container opening. In use, a user can obtain a fluid from the container through the outlet.

The outlet may be sealable and may be self-sealing. In the self-sealing examples, the outlet is selectively openable. When a user applies pressure by mouth or by inserting their hand, the outlet is in an open state. When the user releases the pressure, by removing their mouth ceasing sucking or removing their hand from the outlet, the outlet automatically closes.

Furthermore, a seal may be created between the container sidewall and the flexible sidewall.

The top wall may include a spout, a stopper and opening arrangement, opening sized to fit a variety of different sized straws, or an opening sized to fit a user's hand.

The lid may include one or more of the following features: a hinge for folding the lid for storage, integrally formed handle(s), roll-stop projection(s), a vent hole, a securing strap, a tapered sidewall.

With respect to the tapered sidewall the diameter of the lid at the top may be greater than the diameter of the lid at the bottom.

BRIEF DESCRIPTION OF THE DRAWINGS

In the accompanying drawings that form a part of the specification and are to be read in conjunction therewith, illustrate by way of example and not limitation, with like reference numerals referring to like elements, wherein.

DETAILED DESCRIPTION

Figure 1:
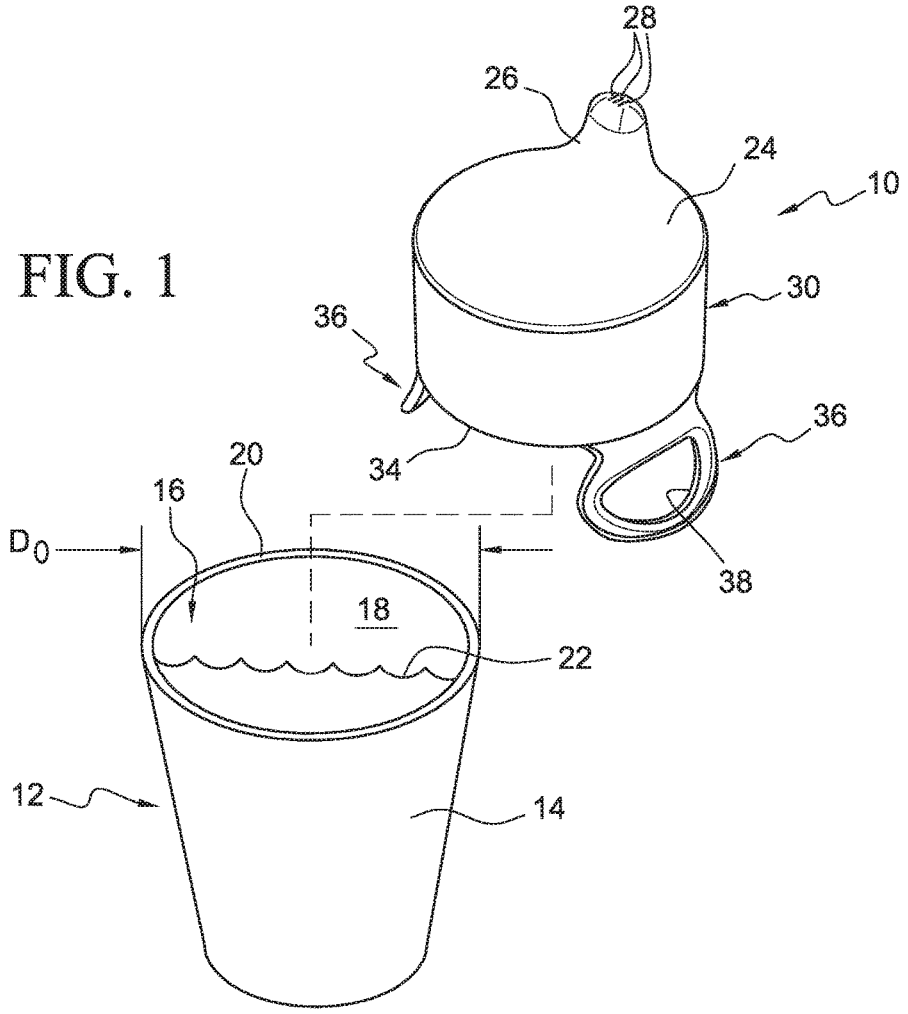
FIG. 1 is a perspective view of a first exemplary universal lid of the present disclosure showing a spill-proof mouthpiece suitable for liquid applications for children, the lid is shown exploded from a container.

Referring to FIG. 1, universal lid 10 of a first exemplary configuration is shown. During use, lid 10 may be applied to a plurality of containers, cups, or drinking vessels one such container being container 12. Container 12 includes container sidewall 14 defining opening 16 and chamber 18. Container 12 further includes lip 20. Chamber 18 contains liquid 22. Container opening 16 has outer opening diameter $D_O$.

Figure 2:
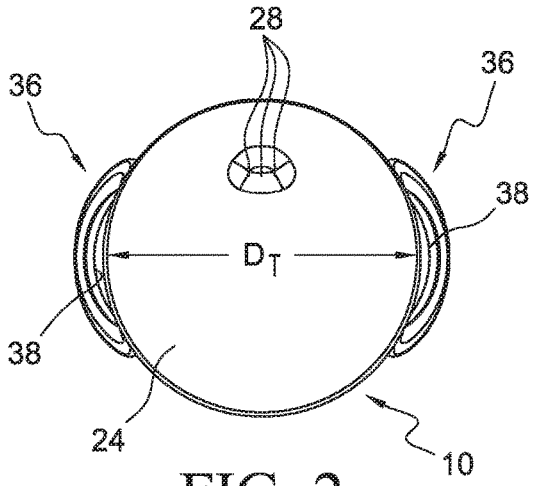
FIG. 2 is a top view of the first exemplary lid of FIG. 1.

Referring to FIGS. 1-2, lid 10 further includes flexible top wall 24 with an integrally formed upwardly extending mouthpiece, spout or spout portion 26. Spout 26 defines elongated channel 27 (shown in FIG. 6) and includes spill-proof lid openings or outlets 28. Although three openings 28 are shown, an alternative embodiment may have one, two or more than three openings. Openings 28 may be selectively openable and may be self-sealing due to the configuration and material used. As a result, a user may obtain a fluid 18 from container 12 from spout 26. Pressure may be applied to spout portion 26, in order to open openings 28. This may be done by a user gently biting down on spout portion 26. Alternatively, a user can apply pressure by sucking on spout portion 26 to open openings 28. Once the pressure is released, openings 28 automatically close. Spout portion 26 may be designed with the contours of a child's mouth in consideration.

Figure 3:
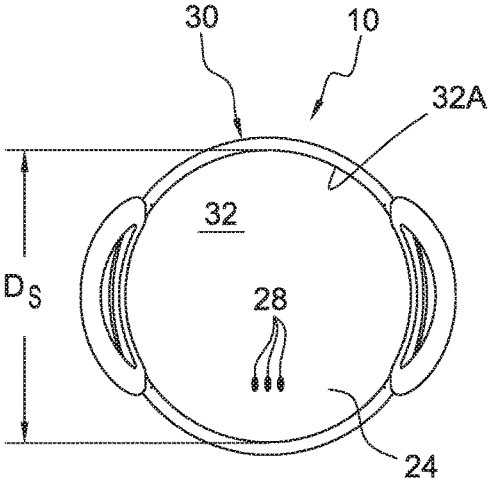
FIG. 3 is a bottom view of the first exemplary lid of FIG. 1.
Figure 4:
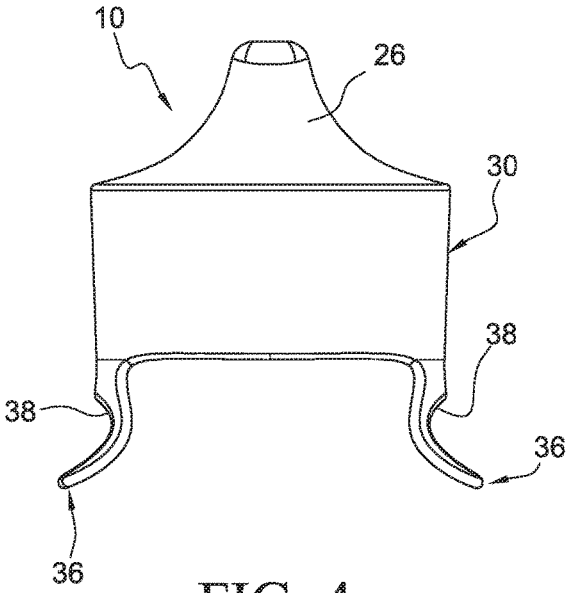
FIG. 4 is a front view of the first exemplary lid of FIG. 1.
Figure 6:
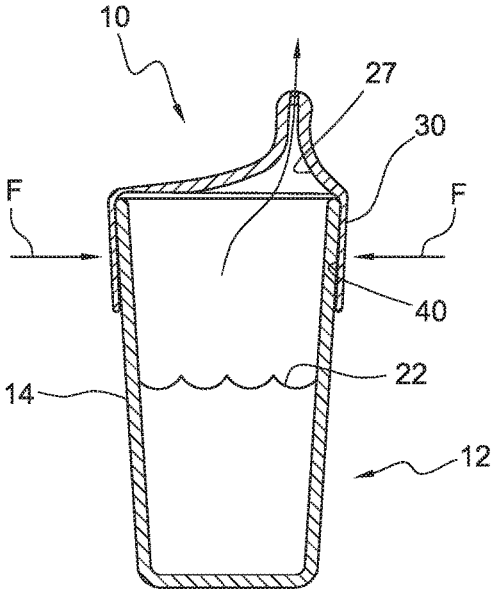
FIG. 6 is a cross-sectional view of the first exemplary lid of FIG. 1 installed on the container of FIG. 1.

Referring to FIGS. 1-3, lid 10 also includes flexible sidewall 30 extending downwardly from and surrounding top wall 24 to define chamber 32 (shown in FIG. 3) therein with chamber opening 32*a*. Chamber 32 and channel 27 are in fluid communication, as shown in FIG. 6. In an initial state, chamber opening 32*a* has a first size and in a second state (shown in FIG. 6) chamber opening pa has a second size different from the first size.

Referring again to FIG. 3, inner sidewall diameter $D_S$ (shown in FIG. 3) is less than outer opening diameter $D_O$ (see FIG. 1) of container 12 so that upon applying or installing lid 10 on container 12, top wall 24 and/or sidewall 30 stretch from the initial state to the second state and sidewall 30 is located adjacent container sidewall 14 and closes container opening 16. In addition, sidewall 30 applies a compressive force on container 12 to create a first seal (as discussed below). Direction of compressive force F is shown in FIG. 6, and exists continuously around the circumference of container 12.

Referring to FIG. 1, sidewall 30 further includes free edge 34. In the present example, free edge 34 includes a pair of integrally formed, diametrically opposed handles 36. Referring to FIGS. 2-5, each handle 36 defines opening 38.

Referring again to FIGS. 1-3, in the present example, top wall 24 and sidewall 30 may be generally circular in shape. In FIGS. 1-5, lid 10 is shown in an unstretched or initial state where chamber opening 32*a* has a first size and where lid 10 has not been installed on container 12.

Figure 5:
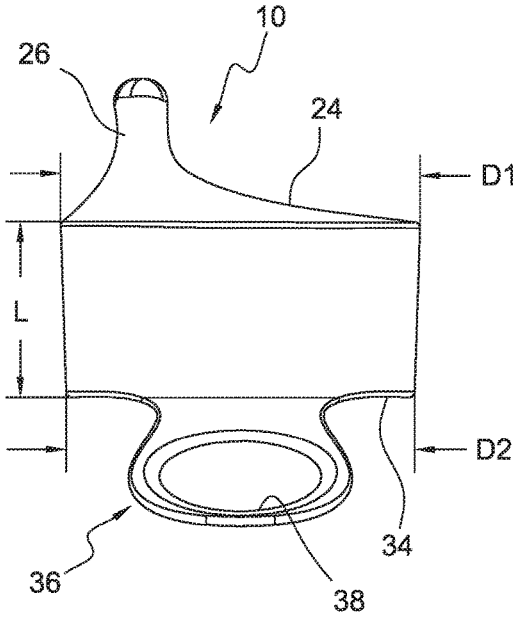
FIG. 5 is a side view of the first exemplary lid of FIG. 1.

In an initial state, as shown in FIG. 5, lid 10 may have a tapered shape from top wall 24 to free edge 34. As a result, lid 10 has first diameter D1 greater than second Diameter D2. The least amount of taper may be 3 degrees, however a larger taper may also be used.

FIGS. 1-5 show lid 10 as it applies to vessels containing liquid. In use, referring to FIG. 1, flexible lid 10 is stretched over container 12 so that mouthpiece 26 is situated over container opening 16 near lip 20 and container opening has a second size larger than first size. Sides or sidewalls 30 of lid 10 are pulled down the side or sidewall 14 of container 12 using handles 36 until lid 10 becomes "taut" across top or top wall 24 and "taut" along sides or sidewall 30. "Taut" means top wall 24 and sidewall 30 have no slack and as a result are tightly drawn.

Handles 36, thus, aid in pulling lid 10 onto container 12. When lid 10 is in the stretched state, sidewall 30 of lid compresses against sidewall 14 of container 12. As shown in FIG. 6, seal 40 is thus created between container sidewall 14 and lid sidewall 30. As a result, vessel or container 12 can now be tipped over or held upside down without the fear of liquid 22 pouring out. First seal is strong enough to remain secure upon inversion (or turning container 12 completely upside down when the container contains some liquid or is completely full.

This same method is followed regardless of the size of container opening $D_O$ (See FIG. 1), provided it falls within the required range for that exemplary lid 10. Each exemplary lid 10 is designed to fit a size range of containers 12 appropriate to its function.

The sizing of lid 10 in FIG. 1 to FIG. 5 is sufficient to work on the vast majority of drinking vessels that a user may have available. The vessels of various sizes may have opening diameter $D_O$ of 60 mm ($2\frac{23}{64}$ inches) to 90 mm ($3\frac{35}{64}$ inches). Lid 10 may have a first size or sidewall less than about 60 mm and may stretch to a second size to accommodate an opening diameter $D_O$ of 95 mm thus difference between the first and second sizes may be at least about 30 mm. However, the present invention is not limited to the present size and if used with larger or smaller containers the size of lid 10 can be adjusted to accommodate other size ranges of containers.

Lid 10 maybe easily removed from container 12 by stretching and removing lid 10 from therefrom. Then, container 12 can be refilled, cleaned or the like. When additional consumption of the liquid may be desired, lid 10 may be replaced again on the same or a different container.

The resilient nature of the material forming lid 10 as well as sidewall diameter $D_S$ of lid (see FIG. 3) in the unstretched state being smaller than outer diameter $D_O$ of the container used therewith, allows lid 10 to exert a compressive force on container 12 and securely connects lid 10 with container 12 and allows lid 10 to remain thereon until it is removed.

Lid 10 and spout 26 are molded into an elastic, relatively rigid predetermined shape. As a result, lid 10 and spout 26 are sufficiently rigid to maintain their shape and elastic so that they return to their original shape upon release.

Figure 7:
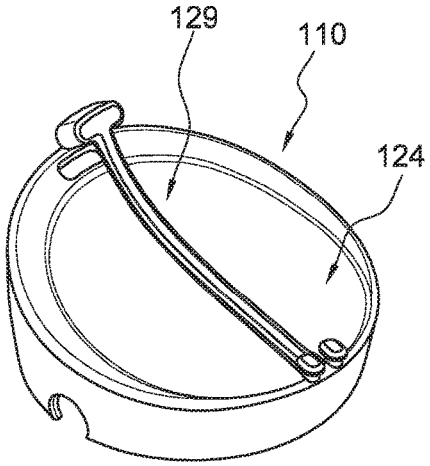
FIG. 7 is a perspective view of a second exemplary lid of the present disclosure showing a spill-proof mouthpiece with a leak-proof seal feature near a closed position, more suitable for adult use.
Figure 8:
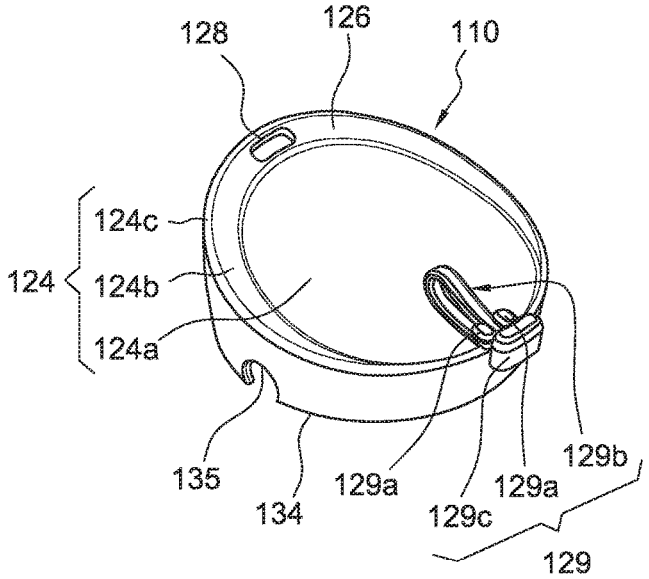
FIG. 8 is a perspective view of the second exemplary lid of FIG. 6 with the seal feature in an open position.
Figure 9:
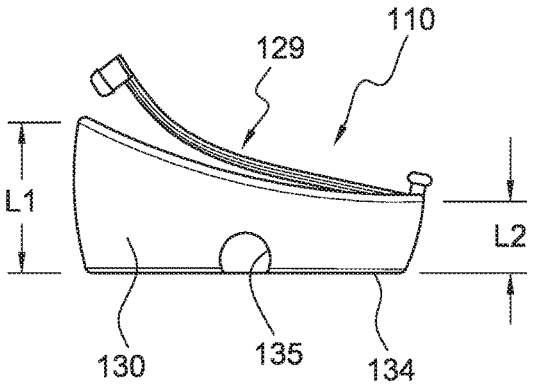
FIG. 9 is a side view of the second exemplary lid of FIG. 6.

Referring to FIGS. 7-9, second exemplary lid 110 is shown. Lid 110 is similar to lid 10 of FIG. 1 in that it is tapered. Lid 110 is different from lid 10 in that lid 110 is configured for use by an adult. Referring to FIG. 7, lid 110 includes top wall 124 with integrally formed central portion 124*a*, intermediate portion 124*b*, and exterior portion 124*c*. Intermediate portion 120 extends at an angle with respect to central portion 124*a* thereabout. Intermediate portion 124*b* and exterior portion 124*c* form mouthpiece or spout portion 126. Spout portion 126 defines opening 128. Spout portion 126 may be designed with the contours of an adult's mouth in consideration. Opening 128 and lid 110 may reduce splashing of a liquid from a cup.

Referring to FIG. 7 to FIG. 9, lid 110 includes spill-proof feature 129 including prongs 129*a*, flexible arm 129*b* and stopper 129*c*. Movable stopper 129*c* may selectively open and close opening 128. Prongs 129*a* are configured and dimensioned to secure arm 129*b* therebetween to hold spill-proof feature 129 in an open position (as shown in FIG. 7). Stopper 129*c* and opening 128 are configured and dimensioned so that in its closed position, stopper 129*c* may be secured within opening or drinking hole 128 and prevents spilling and leaking of liquid therefrom. As a result, a spill-proof seal may created when stopper 129*c* is installed in opening 128. In addition, in the closed position feature 129 acts to trap in heat from hot liquids so that they may remain hot for longer.

Figure 10:
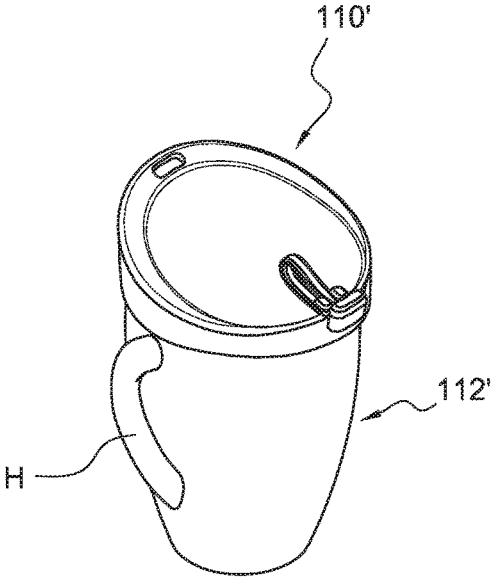
FIG. 10 is a perspective view of a third exemplary lid of the present disclosure showing the lid on a container.
Figure 11:
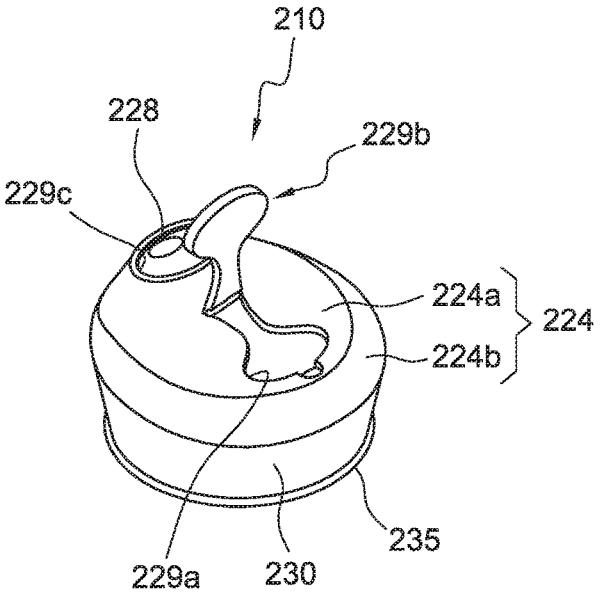
FIG. 11 is a perspective view of a fourth exemplary lid of the present disclosure showing a spill-proof access point suitable for liquid applications for adult use.
Figure 12:
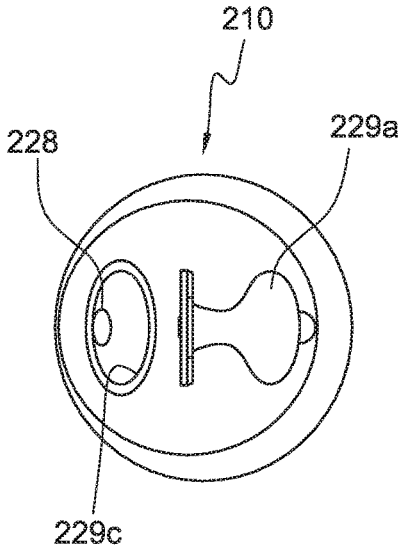
FIG. 12 is a top view of the fourth exemplary lid of FIG. 11.
Figure 13:
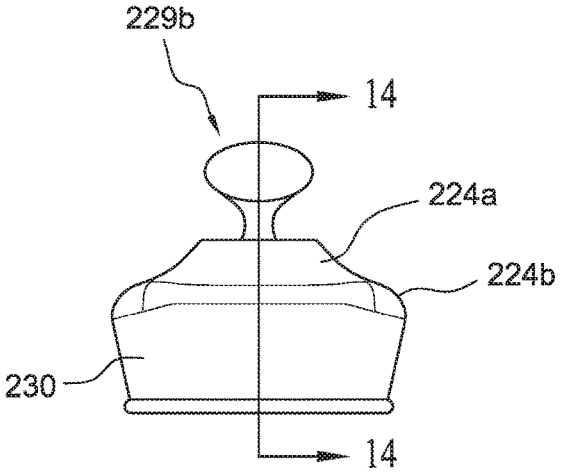
FIG. 13 is a front view of the fourth exemplary lid of FIG. 11.
Figure 14:
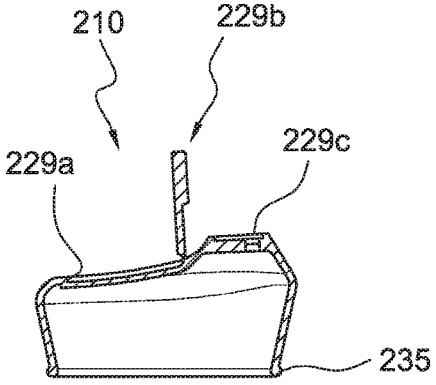
FIG. 14 is a cross-sectional view of the fourth exemplary lid along line 14-14 of FIG. 13.

Referring to FIGS. 1 and 10, sidewall 130 of lid 110 may have a tapered shape so that the front has first length L1 less than rear second length L2. Sidewall 130 further includes free edge 134 that includes cutout feature 135 to help lid 110 fit around handle H (see FIG. 10) of mug 212 (see FIG. 10).

Lid 110 may be sufficiently sized to cover the range of drinking vessel sizes that an adult would expect to drink from. This lid size may accommodate opening diameter $D_O$ (see FIG. 1) of about 65 mm ($2\frac{9}{16}$ inches) to about 100 mm ($3\frac{15}{16}$ inches). Thus, in this example the first size may be less than about 65 mm and the second size may accommodate opening diameter $D_O$ of about 100 mm and the difference may be 35 mm.

This embodiment is applied in the same way as stated above with respect to lid 10. By stretching lid 110 over vessel 112 (shown in FIG. 10) and pulling it all the way down sides 114 of vessel 112 to create a spill-proof seal therewith (as previously discussed). Lid 110 can be used on a variety or plurality of containers of different sizes, as previously discussed with respect to lid 10.

Referring to FIG. 10, third exemplary lid 110' is shown. Lid 110' is similar to lid 110 of FIG. 6 except lid 110' does not include cutout 135 (shown in FIG. 9). Lid 110' is show on container 112' with handle H.

Referring to FIGS. 11-14, fourth exemplary lid 210 is shown. Lid 210 is similar to lid 110 of FIG. 1 and is configured for use with an adult. Except spill-proof feature 229 may be configured differently. Spill-proof feature 229 includes securement recess 229*a*, stopper 229*b*, and closure recess 229*c*. When feature is in a fully open position, stopper 229*b* is within securement recess 229*a* and stopper 229*b* and recess 229*c* are configured and dimensioned to hold stopper 229*b* within recess 229*c*. When feature 229 is moved to a closed position, stopper 229*b* is within closure recess 229*c* and these features are configured and dimensioned to hold stopper 229*b* therein in a spill-proof manner and seal opening 228.

Lid 210 is also different from lid 110 in that top wall 224 includes central portion 224*a* and rounded exterior portion 224*b*. Furthermore, lid 210 includes sidewall 230 with thickened area or rim 235. Rim 235 allows a user to more easily grasp lid 210 for removal thereof.

This embodiment is applied in the same way as stated above with respect to lid 10. By stretching lid 210 over a vessel and pulling it all the way down sides 114 of vessel 112 to create a spill-proof seal therewith (as previously discussed). Lid 210 can be used on a variety of container of different sizes as previously discussed with respect to lid 10.

Figure 15:
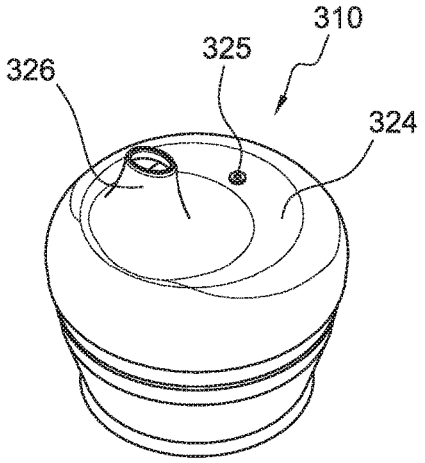
FIG. 15 is a front, perspective view of a fifth exemplary lid of the present disclosure showing a spill-proof access point suitable for liquid applications for children.
Figure 16:
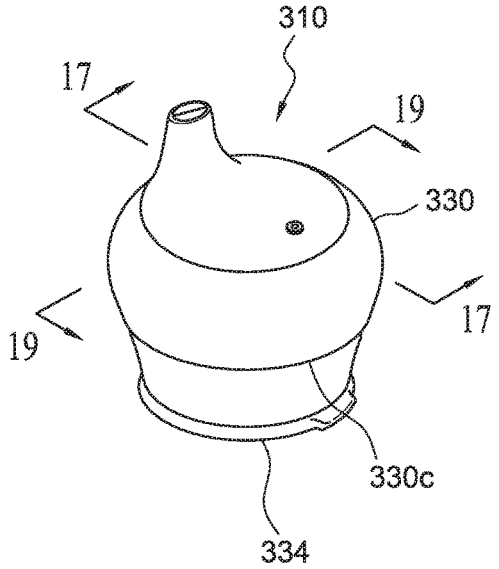
FIG. 16 is a rear, perspective view of the fifth exemplary lid of FIG. 15.
Figure 17:
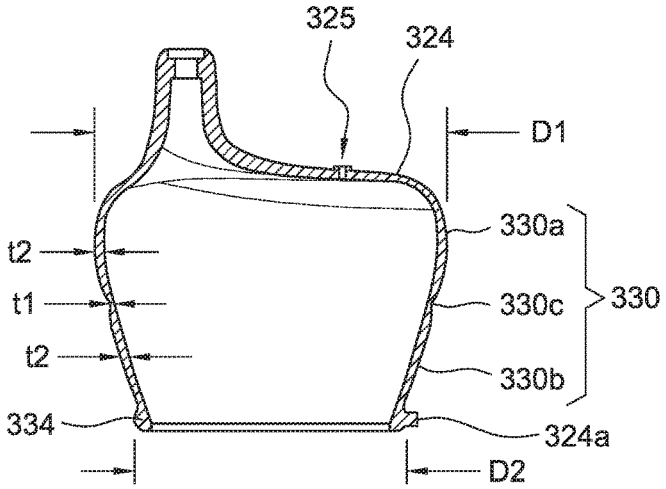
FIG. 17 is a cross-sectional view of the fifth exemplary lid of FIG. 15 along line 17-17 of FIG. 16, with the lid shown in an original state.

Referring to FIGS. 15-17, fifth exemplary lid 310 is shown. Lid 310 is similar to lid 10 of FIG. 1 except lid 310 does not include handles 36 (shown in FIG. 1) and spout portion 326 has a different shape from spout portion 26 (shown in FIG. 1). Spout portion 326 of lid 310 may be formed of the same material as the rest of top wall 324 or spout portion 326 may be formed of a different material as the rest of top wall 324. For example, spout portion 326 may be formed of a harder, bite-proof second material and remainder of top wall 324 formed of a softer first material. The first and second materials can be silicones with different hardness values co-molded together, for example.

Figure 18:
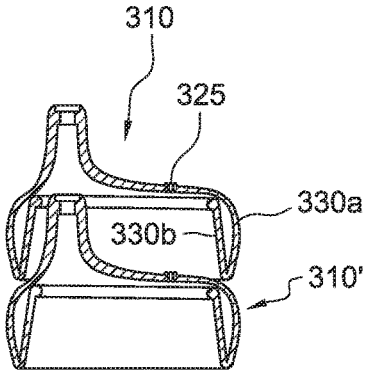
FIG. 18 is a cross-sectional view of two fifth exemplary lids of FIG. 15 shown in a folded state and stacked, where an alternative vent is shown.
Figure 19:
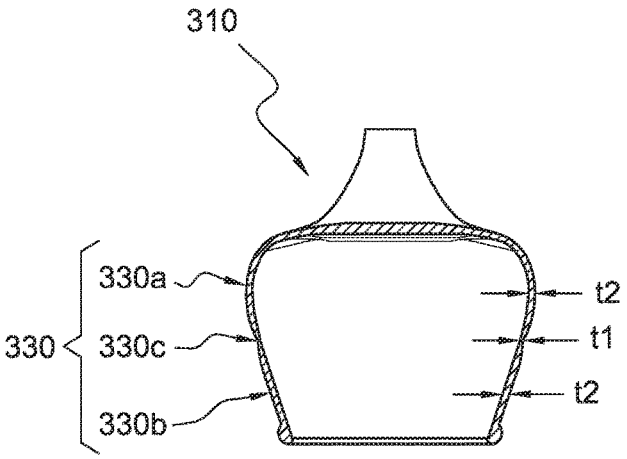
FIG. 19 is a cross-sectional view of the fifth exemplary lid of FIG. 15 along line 19-19 of FIG. 16, with the lid shown in an original state.

Referring to FIGS. 17-19, in addition, lid 310 includes sidewall 330 with upper section 330*a* and lower section 330*b* joined by hinge section 330*c*. Upper section 330*a* and lower section 330*b* have first thickness t1 and hinge section 330*c* has second thickness t2, where second thickness t2 is less than first thickness t1. As a result, when upward and inward forces F (shown in FIG. 17) are applied to lower section 330*b*, hinge section 330*c* allows lower section 330*b* to fold into upper section 330*a* in to a folded position. As a result, the size of lid 310 is reduced for storage and transport. Once folded, lid 310 can be stacked on another lid 310' in a nested arrangement as shown in FIG. 18. To unfold lid 310, a force opposite to force F is applied to lower section 330*b* to remove it from upper section 330*a*.

Referring to FIGS. 15 and 17, top wall 324 includes vent opening 325. Vent opening 325 may have a funnel shape so that it is larger at the top and decreases in diameter downwardly. Vent opening 325 aids in allowing liquid to be sucked out of container 312 (shown in FIG. 20).

In addition, sidewall 330 of lid 310 may include a thickened rim 334 that may include an outwardly extending projection 324*a*. If a container with lid 310 thereon is knocked over, roll-stop projection 324*a* prevents lid 310 from rolling. Thus, potentially preventing lid 310 and cup attached thereto from rolling off a surface, for example a table. In an alternative example, lid may include more than roll-stop one projection 324*a*. For example, two or more spaced apart projections may be used or a series of tabs, bumps or shaped edges may be used as roll-stops.

In an initial state (as shown in FIG. 17), lid 310 is also tapered, however the taper is greater than that of lid 10. Lid 310 may have a taper where first diameter D1 at free edge 334 is over 25% narrower than second diameter D2 at top wall 324. The lid may be about 35% narrower at the bottom than at the top.

Figure 20:
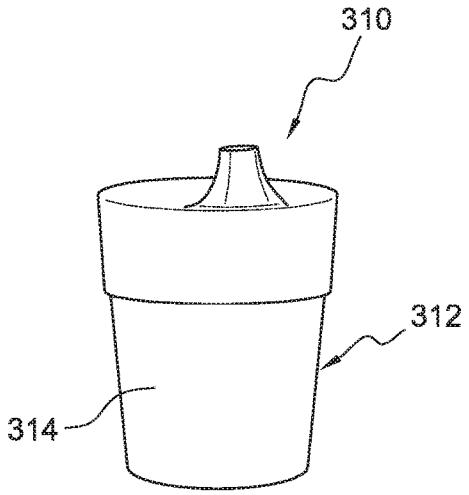
FIG. 20 is a side, perspective view of the fifth exemplary lid of FIG. 15 shown in use.

This embodiment is applied in the same way as stated above with respect to lid 10. Referring to FIG. 20, by stretching lid 310 over vessel 312 (in the unfolded state) and pulling it all the way down the sides 314 of vessel 312 to create a spill-proof seal therewith (as previously discussed). Lid 310 may be used on a variety of containers of different sizes as previously discussed with respect to lid 10.

Figure 21:
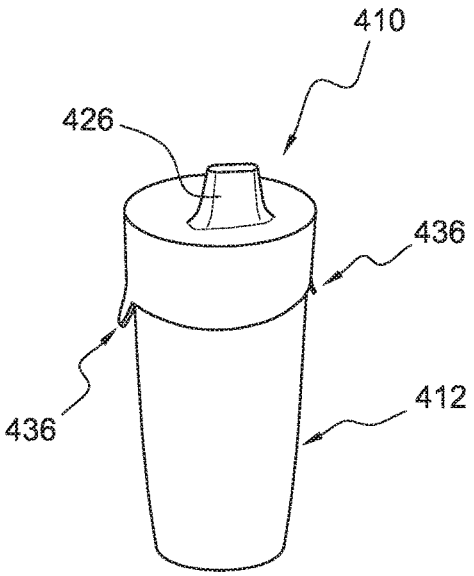
FIGS. 21-22 are perspective views of a sixth exemplary lid of the present disclosure showing a spill-proof access point suitable for liquid applications for children, where the lid is connected to two different containers.
Figure 22:
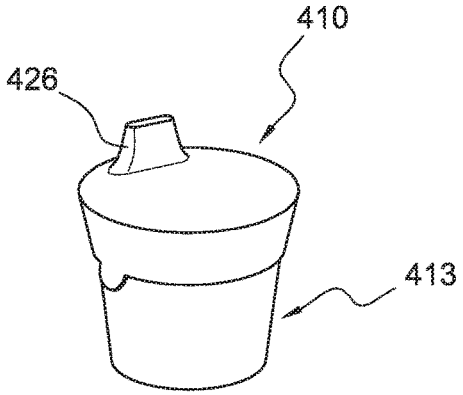

Referring to FIGS. 21-22, sixth exemplary lid 410 is shown. Lid 410 is similar to lid 10 of FIG. 1 except lid 410 does not include handles 36 with openings 38 (shown in FIG. 1), but includes tabs 436 for assisting in pulling lid 410 onto containers 412 and 413. Furthermore, lid 410 has spout portion 426 with a different shape from spout portion 26 (shown in FIG. 1), but similar to mouthpiece 326 (shown in FIG. 54).

In FIGS. 21 and 22, lid 410 is shown in use stretched over containers 412 and 413. Container 412 has one opening diameter $D_O$ (see FIG. 1). In FIG. 22, container 413 has opening diameter $D_O$ (see FIG. 1) different from container 412. In addition, containers 412 and 313 have different overall shapes, heights and materials. Lid 410 may be used like lid 10.

Figure 23:
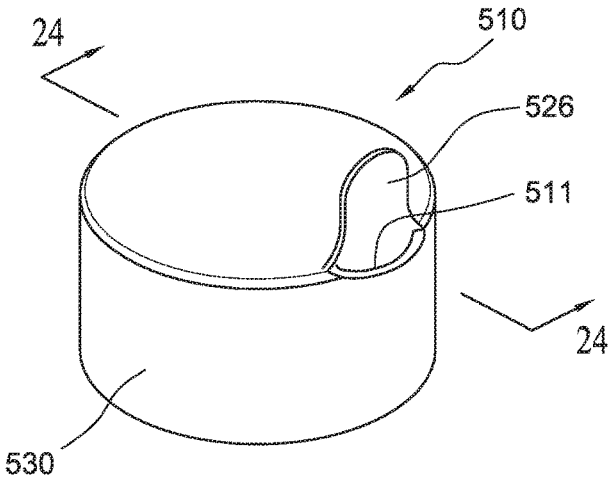
FIG. 23 is a perspective view of a seventh exemplary lid of the present disclosure showing a spill-proof access point suitable for liquid applications for children, where the spout is in an open position.
Figure 24:
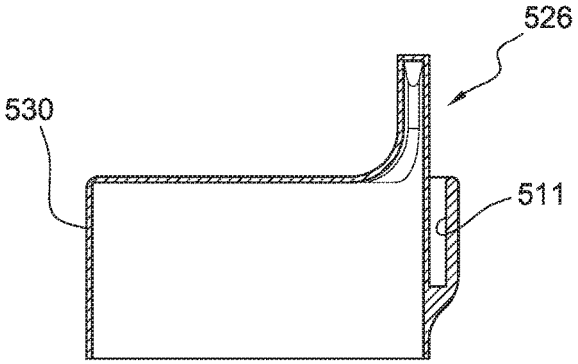
FIG. 24 is a cross-sectional view of the seventh exemplary lid of FIG. 23 along line 24-24 thereof.
Figure 25:
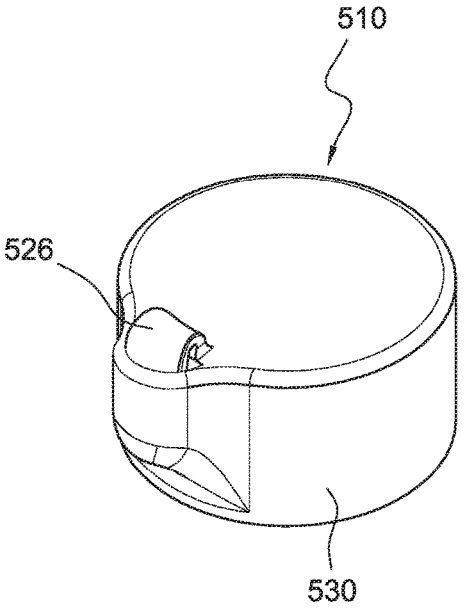
FIG. 25 is a perspective view of the seventh exemplary lid of FIG. 23, where the spout is in a closed or folded position.

Referring to FIGS. 23-25, seventh exemplary lid 510 is shown. Lid 510 is similar to lid 410 of FIG. 21 except lid 510 includes chamber 511 defined adjacent sidewall 530 and integrally formed therewith. Furthermore, spout portion 526 is configured and dimensioned to be bendable so that when not in use spout portion 526 can be disposed within chamber 511 (as shown in FIG. 25) so that spout portion 526 remains clean. Spout portion 526 is shown in the folded or stored position in FIG. 25 and in the in use position in FIGS. 23 and 24. Lid 510 may be applied to a container like lid 10.

Figure 26:
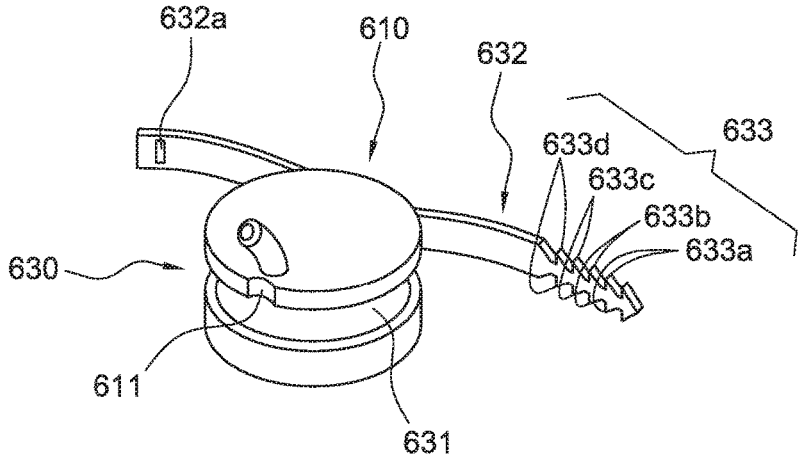
FIG. 26 is a perspective view of a eighth exemplary lid of the present disclosure showing a spill-proof access point suitable for liquid applications for children, where a strap and a spout are in an open position.
Figure 27:
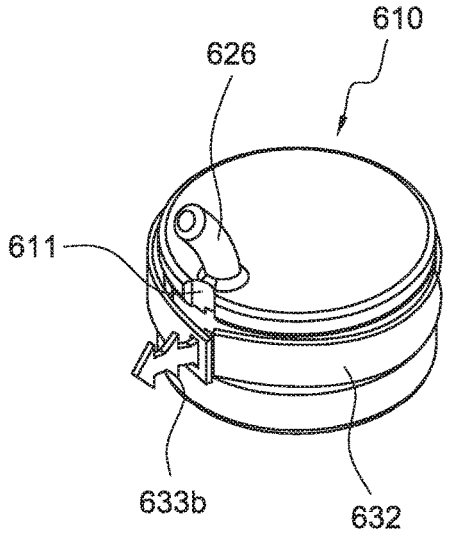
FIG. 27 is a perspective view of the eighth exemplary lid of FIG. 26, where the strap is in a closed position.
Figure 28:
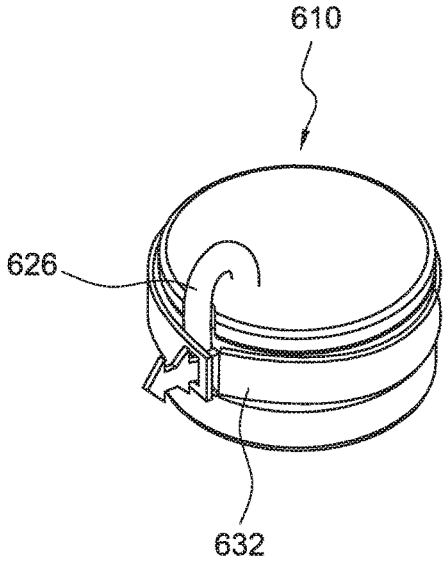
FIG. 28 is a perspective view of the eighth exemplary lid of FIG. 26, where the strap and spout are in a closed position.

Referring to FIGS. 26-28, eighth exemplary lid 610 is shown. Lid 610 is similar to lid 410 of FIG. 21 except lid 610 includes notch 611 and channel 631 defined within sidewall 630. Furthermore, sidewall 630 includes integrally formed strap 632. Channel 631 receives strap 632 and assists in securing strap 632 in position on lid 610. Strap 632 further includes opening 632*a* defined therein and working end portion 633 defining a series of spaced apart paired projections 633*a*, 633*b*, 633*c*, 633*d*. When strap 632 is secured around lid 610 as shown in FIG. 227, opening 632*a* and projections 633*b* are configured and dimensioned to secure strap 632 about lid 610. This aids in securing lid 610 to a container (not shown) by increasing the dexterity and force necessary to remove lid 610. Thus, a child may find removal of lid 610 more difficult.

In lid 610, spout portion 626 may be configured in a cylinder and dimensioned to be bendable so that when not in use spout portion 626 can be disposed within groove 611 (as shown in FIG. 28) so that it may be spill-proof when not in use. In the in-use position (see FIG. 27), spout portion 626 allows liquid to flow therethrough. Applying of lid 610 to various containers is similar to lid 10.

Figure 29:
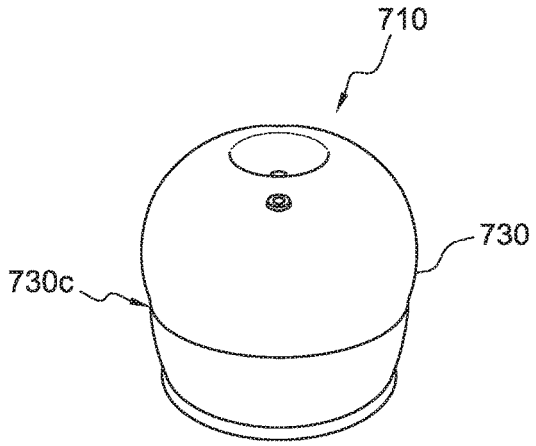
FIG. 29 is a perspective view of a ninth exemplary lid of the present disclosure showing a spill-proof access point suitable for liquid applications for children.
Figure 30:
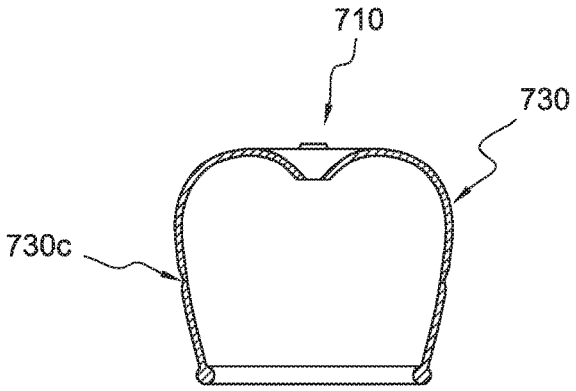
FIG. 30 is a partial, cross-sectional view of the ninth exemplary lid of FIG. 29.
Figure 31:
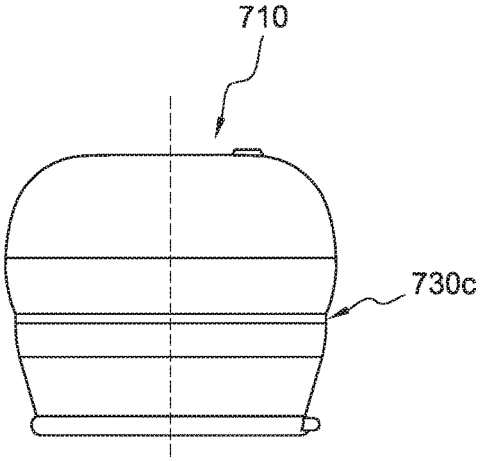
FIG. 31 is a side view of the ninth exemplary lid of FIG. 29, with the lid shown in an original state.
Figure 32:
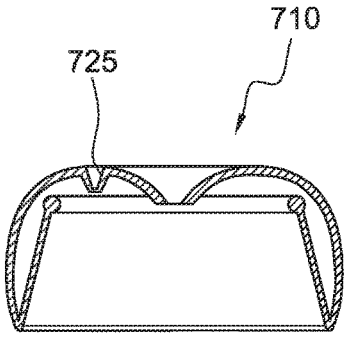
FIG. 32 is a cross-sectional view of the ninth exemplary lid of FIG. 29 shown in a folded state, where an alternative vent is shown.

Referring to FIGS. 29-31, ninth exemplary lid 710 is shown. Lid 710 is similar to lid 310 of FIG. 15 and includes hinge section 730*c* as part of sidewall 730. As a result, lid 710 can be used in an unfolded state, as shown in FIGS. 29-31 and stored in a folded state, as shown in FIG. 32. Lid 710 may be folded and stacked as previously discussed with respect to lid 310. Changing lid 810 from unfolded or original state to the folded state and vice versa is accomplished as discussed with respect to lid 310. Lid 710 further includes funnel-shaped vent 725 similar to vent 325.

Figure 33:
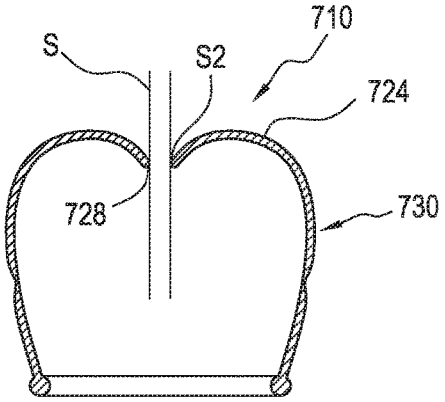
FIG. 33 cross-sectional view of the ninth exemplary lid of FIG. 29 in use.

Lid 710 is different from lid 310 in that it lacks a spout portion like spout portion 326 and includes opening 728 suitable for use with straw S (see FIG. 33). Furthermore, lid 710 is shaped to have a continuous radius of curvature between the sidewall 730 and top wall 724 (as seen in FIG. 33).

Figure 34:
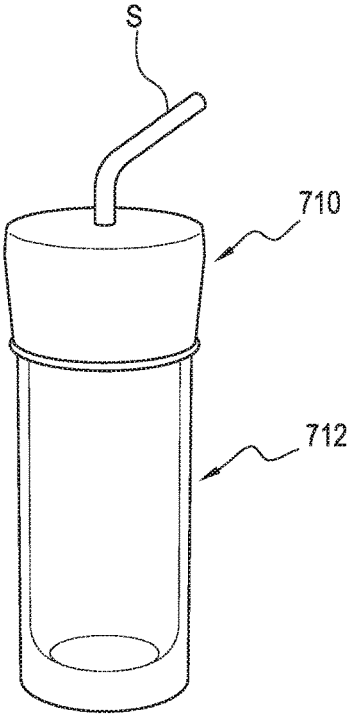
FIGS. 34-35 are perspective views of the ninth exemplary lid of FIG. 29 in use on two different sized containers.
Figure 35:
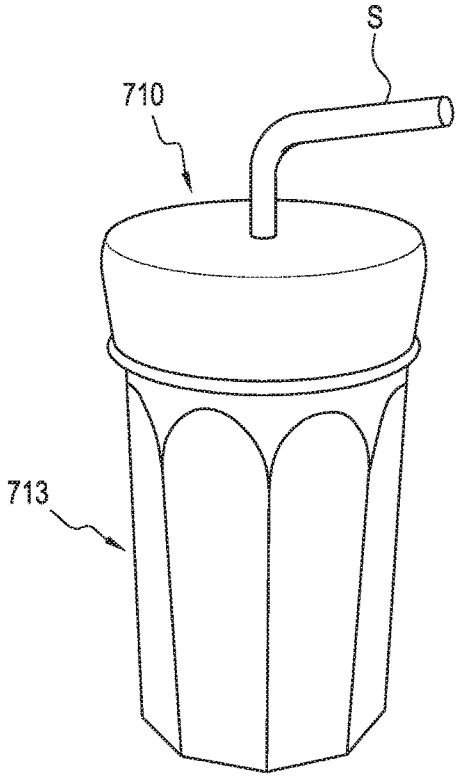

In FIGS. 34-35, lid 710 is shown in-use, stretched over containers 712 and 713. Container 712 has one opening diameter $D_O$. (see FIG. 1). In FIG. 35, container 713 has opening diameter $D_O$ (see FIG. 1) different from container 812. In addition, containers 712 and 713 have different overall shapes, heights and materials. Use and sealing of lid 710 to a container is similar to lid 210.

Referring to FIG. 33, when a user inserts straw S into opening 728, lid 710 creates second seal S2 about straw S. As a result, opening 728 becomes a spill-proof opening. Thus, spill-proof first seal is formed between sidewall 730 of lid 710 and container 712 or 713 (as previously discussed with respect to lid 10) and second spill-proof seal S2 is created between lid 710 and straw S.

Figure 36:
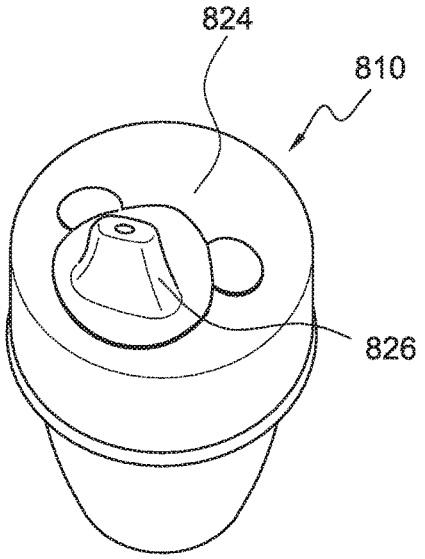
FIG. 36 is a front, perspective view of a tenth exemplary lid of the present disclosure showing a spill-proof access point suitable for liquid applications for children, the lid is shown in use on a container.
Figure 37:
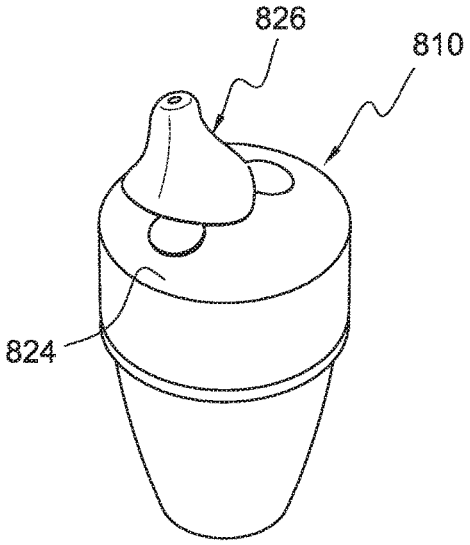
FIG. 37 is a rear, perspective view of the tenth exemplary lid of FIG. 36.
Figure 38:
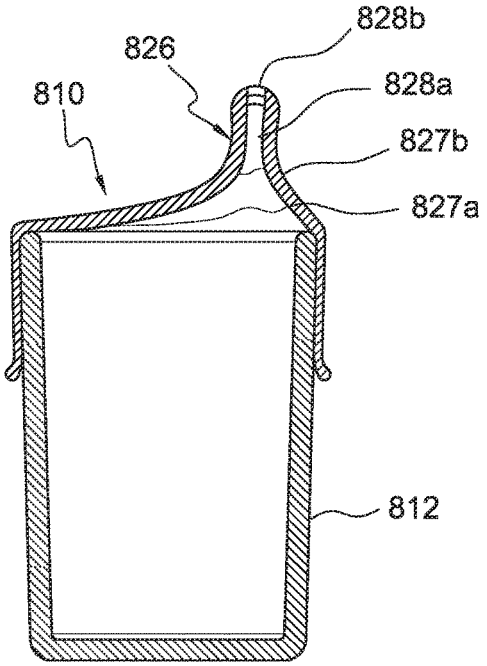
FIG. 38 is a cross-sectional view of the tenth exemplary lid of FIG. 36.

Referring to FIGS. 36-38, tenth exemplary lid 810 is shown. Lid 810 similar to lid 310 of FIG. 15, except lid 810 includes different spout portion 826. Top wall 824 is formed of two different materials. The spout portion 826 includes first layer 827*a* of soft material and co-molded second outer layer 827*b* of a harder material. First layer 827*a* includes slit 828*a* aligned with larger opening 828*b* defined in second layer 828*b*. When a user sucks liquid out of lid 810, the pressure causes slit 827*a* to selectively open allowing liquid to flow out of opening 828*b*. When the pressure is released, slit 827*a* automatically closes making lid 810 spill-proof. Alternatively, spout portion 826 may be formed of a single layer of material substantially more rigid than remainder of lid 810, this allows mouthpiece 826 to be bite proof.

Spout portion 826 may have a figurative or decorative shape, such as for example, an animal shape. Lid 810 shows exemplary teddy bear (as shown) shaped spout 826. Furthermore, mouthpiece 826 and remainder of lid 810 may be of different colors. In FIG. 38, lid 810 is shown in use stretched over container 812. Applying of lid 810 to container 812 is similar to lid 310.

Figure 39:
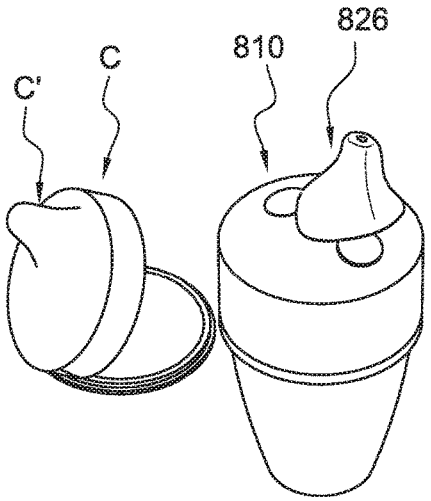
FIG. 39 is a perspective view of the tenth exemplary lid of FIG. 36 in use with a carrying case adjacent thereto.

Lid 810 may include a hinge section similar to lid 310. When in a folded position lid 810 may be stored in a carrying case C (shown in FIG. 39). Carrying case C may be used with various lids and sized to contain the lid for clean transport and storage. Carrying case is formed using conventional manufacturing methods and may include a living hinge and a snap fit. Carrying case C may be formed to have a decorative shape C'. Lid 810 may also include a roll-stop projection as previously discussed.

Figure 40:
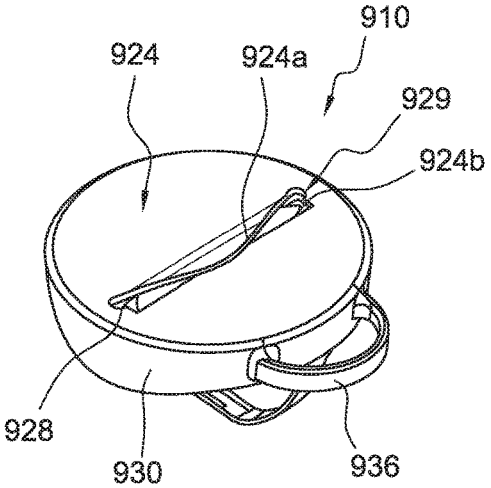
FIG. 40 is a perspective view of an eleventh exemplary lid of the present disclosure showing a spill-proof access point suitable for food applications.
Figure 41:
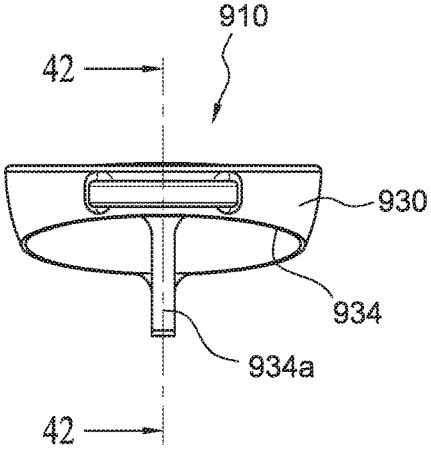
FIG. 41 is a rear view of the eleventh exemplary lid of FIG. 40.
Figure 42:
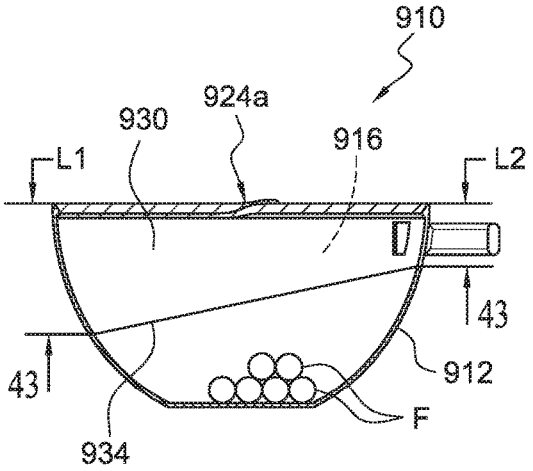
FIG. 42 is a partial, cross-sectional, side view of the eleventh exemplary lid of FIG. 41 along line 42-42 thereof and showing the lid installed on a bowl.

Referring to FIGS. 40-42, eleventh exemplary lid 910 is shown. Lid 910 is similar to lid 10 of FIG. 1 except lid 910 is configured for use with container 912 that contains food F. Referring to FIG. 40, lid 910 includes top wall 924 with a self-sealing spill-proof opening 928 in the form of elongated slit 929. Top wall 924 includes two overlapping movable flaps 924*a* and 924*b*. When a user's hand (not shown) is inserted into slit 929, flaps 924*a* and 924*b* move to an open state to allow access to food F. When the hand is removed, flaps 924*a* and 924*b* return to their initial state and food F cannot be spilled from container 912. Opening 928 may be sized to fit a child's hand therethrough.

Sidewall 930 may include integral handle 936 defining opening 938. Handle 936 assists in pulling lid 910 onto container 912. Handle 936 also allows the child to easily hold and carry vessel 912 around.

Sidewall 930 further includes free edge 934. In the present embodiment, free edge 934 may be shaped so that sidewall 930 has first length L1 at the front greater than second length L2 at the rear. In an alternative example, first and second lengths L1 and L2 may be substantially the same.

Figure 43:
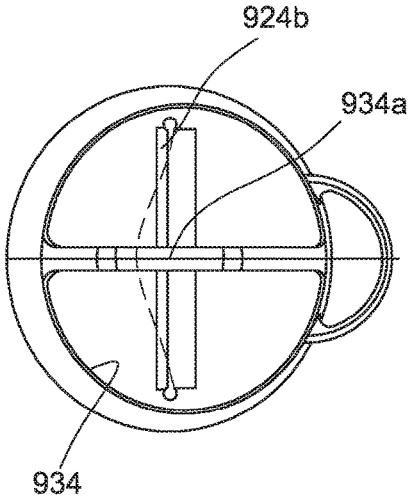
FIG. 43 is a bottom view of the eleventh exemplary lid of FIG. 40.
Figure 45:
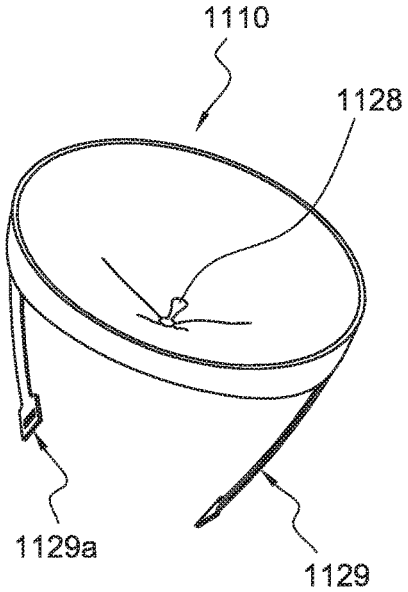
FIG. 45 is a top, perspective view of a thirteenth exemplary lid of the present disclosure showing a spill-proof access point suitable for food applications.

Furthermore, free edge 934 further includes strap 934*a* extending across lid 910 (as best shown in FIG. 43). Strap 934*a* may be flexible, and when installed onto container as shown in FIG. 45 applies an upward force on container 912 to help secure lid 910 thereon. Strap 934*a* may be used to offer additional securement of lid 910 to vessel 912. In an alternative, example lid 910 may not include strap 934*a* or may include strap, which has a different shape such as a cross-shape.

Lid 910 may be applied in the same way as stated above with respect to lid 10. By stretching lid 910 over vessel 912 (shown in FIG. 40) and pulling it all the way down the sides 914 of vessel 912 until lid 910 becomes taut across top 1024 and taut alongside sidewall 930 (see FIG. 42). As a result, lid 910 and vessel 921 have a spill-proof connection, as previously discussed with respect to lid 10.

In FIG. 41-45 lid 910 is sufficiently sized to fit a range of vessels that a child might be expected to hold with one hand while accessing the contents with the other hand. Such vessels may have an opening diameter of 90 mm ($3\frac{15}{16}$ inches to 125 mm ($4\frac{59}{64}$ inches), which is a difference of about 35 mm.

Figure 44:
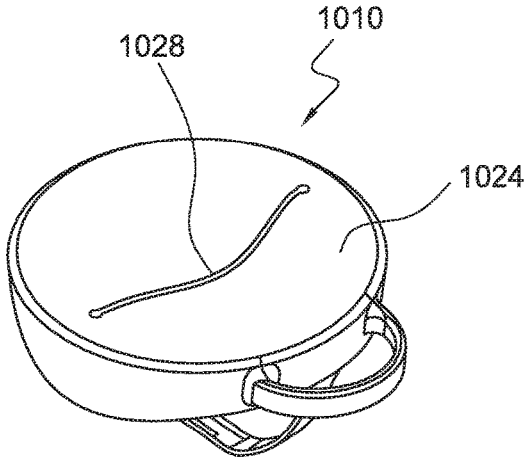
FIG. 44 is a perspective view of a twelfth exemplary lid of the present disclosure showing a spill-proof access point suitable for food applications.

Referring to FIG. 44, twelfth exemplary lid 1010 is shown. Lid 1010 is similar to lid 910 of FIG. 40 except lid 1010 has elongated slit 1028 without flaps 924*a* and 924*b* of FIG. 40. Slit 1028 may be self-sealing. Lid 1010 may be applied to a variety of containers like lid 910.

Figure 46:
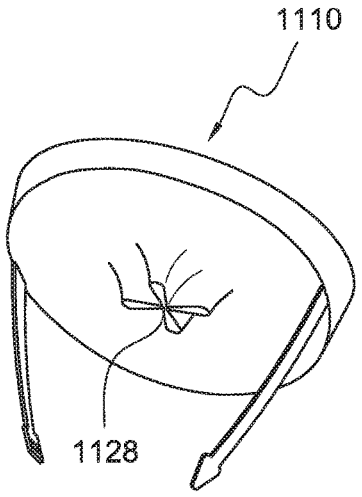
FIG. 46 is a bottom, perspective view of the thirteenth exemplary lid of FIG. 45.

Referring to FIGS. 45 and 46, thirteenth exemplary lid 1110 is shown. Lid 1110 is similar to lid 910 of FIG. 40 except lid 1110 has different shaped opening 1128 for accessing food within a container and strap 1129 has buckle feature 1129*a* for installing and removal. Buckle feature 1129*a* allows strap 1129 to be adjustable.

Figure 47:
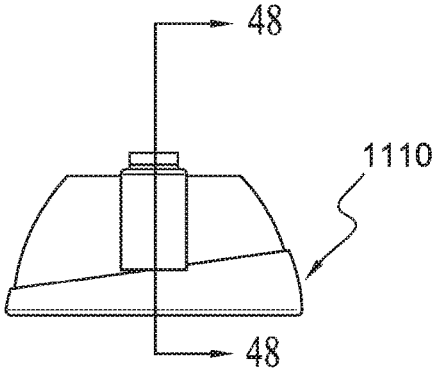
FIG. 47 is a side view of the thirteenth exemplary lid of FIG. 45 shown installed on a bowl.
Figure 48:
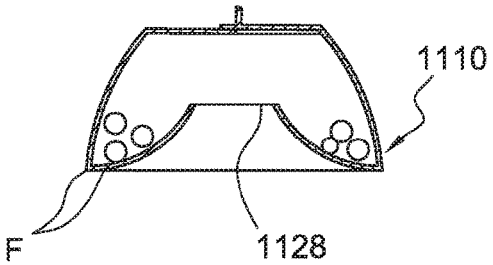
FIG. 48 is a cross-sectional view of the thirteenth exemplary lid of FIG. 47 shown along line 48-48 thereof.

Opening 1128 may have a generally cruciate or cross-shape, however other shapes may be used. In addition, opening 1128 has a funnel shape so that it tapers from a wider width at the top to the more narrow width at the bottom. This allows access to the contents but keeps the contents of the bowl inside when the bowl is inverted. Upon inversion (as shown in FIGS. 47 and 48), food F falls around the perimeter of the funneled opening 128. Lid 1110 may be applied to a variety of containers like lid 910.

Lids 10, 110, 110', 210, 310, 410, 510, 610, 710, 810, 910, 1010, and 1110 may be integrally formed of a single, unitary material using processes, such as for example compression molding, casting, injection molding, 3D printing, or the like. Covers 10, 110, 110', 210, 310, 410, 510, 610, 710, 810, 910, 1010 and 1110 may be formed of a material with one or more of the following properties: stretchy (elongation of greater than 400% at break or between 800% to 1100% at break), flexible, resilient, food safe, dishwasher safe, BPA and Phthalate-free, waterproof material, strong, high chemical resistance, high ultraviolet resistance, high stability, and allergen-free material. Examples of materials, which may be used are Rubber, Thermoplastic Elastomers (TPE) such as TPU and TPR, and Silicone. In alternative embodiments, other materials know to those with skill in the art may be used. In one example, silicone of a 10 Shore A-15 Shore A may be used which has an elongation of 800%-1100% at break.

In some embodiments such as lid 810 (shown in FIG. 32), certain features like mouthpiece 826 may require a harder, stiffer material. An example might be plastics such as Polypropylene or Polyethylene, silicones with a harder durometer, rubbers of a harder durometer, the synthetic polymers sold under the trademark NYLON®, Acrylonitrile Styrene, Acrylonitrile Butadiene Styrene, the copolyester sold under the trademark Triton™, Polycarbonite. It may also be necessary in some embodiments like lid 810 to co-mold the soft plastic of the lid with a hard plastic of a feature in order to benefit from the properties of both.

Those skilled in the art will appreciate that the conception, upon which this disclosure is based, may readily be utilized as a basis for designing other products. Therefore, the claims are not to be limited to the specific examples depicted herein. For example, the features of one example disclosed above may be used with the features of another example. For example, the downwardly tapered sidewall may be incorporated any of the examples. For example, the hinge may be incorporated into other examples. The integrally formed handle(s) may be formed in other examples. For example, the roll-stop projection may be used on other lids. For example, lids may have all or some combination of downwardly tapered sidewall, hinge, rim, vent hole, handles, roll-stop projection, and/or securing strap. Lids of each exemplary configuration may be formed in a variety of sizes and depths, so that they can be used with a variety of containers. Thus, the details of these components as set forth in the above-described examples, should not limit the scope of the claims.

Further, the purpose of the Abstract is to enable the U. S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. A universal lid capable of covering drink containers having various sized openings comprising:

a flexible top wall including an opening; and a flexible sidewall surrounding the top wall and extending downwardly therefrom to a free edge at a bottommost portion of the sidewall, the flexible sidewall having an outer surface defining a generally tapered shape in an unstretched state of the universal lid whereby a first outer sidewall diameter measured at the free edge is smaller than a second outer sidewall diameter measured in a vicinity of the top wall;

wherein the tapered flexible sidewall is capable of being stretched over the various sized openings of the drink containers into a position whereby the flexible sidewall is tightly drawn without slack about the container with a compressive force forming a tight seal therewith while the flexible top wall is capable of being tightly drawn without slack about the opening of the container thereby forming a substantially planar surface over the opening of the drink container and the tight seal allowing the drink container to be tipped over without a liquid spilling out therefrom;

wherein the first outer sidewall diameter of the flexible sidewall is capable of being increased by at least about 30 mm to allow the universal lid to fit over and secure to drink containers having various sized openings; and wherein the flexible sidewall includes an upper section and a lower section joined by a hinge section defined by a reduced thickness with respect to the upper section and the lower section and the reduced thickness of the hinge section being formed in the outer surface of the flexible sidewall whereby the hinge section allows the lower section to pivot into the upper section reducing the size of the universal lid for storage.

2. The universal lid of claim 1, wherein in the unstretched state of the universal lid the flexible top wall includes a rounded exterior portion that extends to the flexible sidewall surrounding the top wall.

3. The universal lid of claim 1, wherein the flexible top wall includes a spout portion and the opening is formed in the spout portion.

4. The universal lid of claim 3, wherein the spout portion is formed of a material that is more rigid than a material forming the flexible top wall.

5. The universal lid of claim 1, wherein in the unstretched state of the universal lid the first sidewall diameter is at least 25% smaller than the second sidewall diameter.

6. The universal lid of claim 1, wherein the flexible top wall includes a vent opening.

7. A universal lid for covering various sizes of drink containers comprising:

a flexible top wall including an opening; and a flexible sidewall having an outer surface and surrounding the top wall and extending downwardly therefrom, the flexible sidewall including an upper section and a lower section joined by a hinge section, the hinge section of the flexible sidewall being defined by a reduced thickness with respect to the upper and lower sidewall sections and the reduced thickness being formed in the outer surface of the flexible sidewall;

wherein the flexible sidewall defines a generally tapered shape in an unstretched state of the universal lid;

wherein in use the flexible sidewall is capable of being stretched over the various sized openings of the drink containers into a position whereby the flexible sidewall is tightly drawn without slack so as to form a tight seal with the container while the flexible top wall is capable of being tightly drawn without slack about the opening of the container thereby forming a substantially planar surface over the opening of the drink container and the tight seal allowing the drink container to be tipped over without a liquid spilling out therefrom;

wherein when not in use the hinge section of the flexible sidewall is configured to allow the lower section to pivot into the upper section into a folded position of the universal lid thereby reducing the size of the universal lid for storage; and wherein the flexible sidewall is capable of being stretched a distance of at least about 30 mm to allow the universal lid to fit over and secure to drink containers having various sized openings.

8. The universal lid of claim 7, wherein when the lower section of the flexible sidewall is pivoted into the folded position, the universal lid is capable of being stacked on another universal lid in a nested arrangement.

9. The universal lid of claim 7, wherein the flexible top wall includes a rounded exterior portion that extends to the flexible sidewall surrounding the top wall in an unstretched state of the universal lid.

10. The universal lid of claim 7, wherein the flexible top wall includes a spout portion and the opening is formed in the spout portion.

11. The universal lid of claim 10, wherein the spout portion is formed of a material that is more rigid than a material forming the flexible top wall.

12. The universal lid of claim 7, wherein the flexible top wall includes a vent opening.

13. A stackable universal lid for covering various sizes of drink containers comprising:

a flexible top wall including an opening; and a flexible sidewall surrounding the top wall and extending downwardly therefrom to a free edge at a bottommost portion of the sidewall, the flexible sidewall having an outer surface defining a generally tapered shape in an unstretched state of the universal lid whereby a first outer sidewall diameter measured at the free edge is smaller than a second outer sidewall diameter measured in a vicinity of the top wall, the tapered flexible sidewall including an upper section and a lower section joined by a hinge section defined by a reduced thickness with respect to the upper section and the lower section and formed in the outer surface of the flexible sidewall;

wherein in use the tapered flexible sidewall is capable of being stretched over the various sized openings of the drink containers into a position whereby the flexible sidewall is tightly drawn without slack so as to form a tight seal with the container while the flexible top wall is capable of being tightly drawn without slack about the opening of the container thereby forming a substantially planar surface over the opening of the drink container and the tight seal allowing the drink container to be tipped over without a liquid spilling out therefrom;

wherein when not in use the hinge section of the tapered flexible sidewall is configured to allow the lower section to pivot into the upper section into a folded position of the universal lid thereby reducing the size of the universal lid for storage;

wherein when the lower section of the flexible sidewall is pivoted into the folded position the universal lid is capable of being stacked on another universal lid in a nested arrangement; and wherein the first outer sidewall diameter of the flexible sidewall is capable of being increased by at least about 30 mm to allow the universal lid to fit over and secure to drink containers having various sized openings.

14. The stackable universal lid of claim 13, wherein in the unstretched state of the universal lid the flexible top wall includes a rounded exterior portion that extends to the flexible sidewall surrounding the top wall.

15. The stackable universal lid of claim 13, wherein the flexible top wall includes a spout portion and the opening is formed in the spout portion.

16. The stackable universal lid of claim 15, wherein the spout portion is formed of a material that is more rigid than a material forming the flexible top wall.

17. The universal lid of claim 13, wherein the flexible top wall includes a vent opening.

18. The universal lid of claim 1, wherein the flexible sidewall includes an inner surface that extends along the upper section, the hinge section, and the lower section, the inner surface forming a continuous smooth surface along the upper section, the hinge section, and the lower section.

19. The universal lid of claim 7, wherein the flexible sidewall includes an inner surface that extends along the upper section, the hinge section, and the lower section, the inner surface forming a continuous smooth surface along the upper section, the hinge section, and the lower section.

20. The universal lid of claim 13, wherein the flexible sidewall includes an inner surface that extends along the upper section, the hinge section, and the lower section, the inner surface forming a continuous smooth surface along the upper section, the hinge section, and the lower section.

* * * * *